United States Patent [19]

Grable

[11] 4,119,075

[45] Oct. 10, 1978

[54] DISTRIBUTOR SPRING FOR USE IN A MAGNETIC SENSOR

[75] Inventor: Ronald C. Grable, Santa Clara, Calif.

[73] Assignee: W. R. Grace & Co., New York, N.Y.

[21] Appl. No.: 713,023

[22] Filed: Aug. 9, 1976

[51] Int. Cl.[2] ..... F02P 1/00

[52] U.S. Cl. ..... 123/146.5 A; 200/19 M; 310/70 R

[58] Field of Search ..... 123/146.5 R, 146.5 A, 123/148 R, 148 E; 200/19 R, 19 A, 19 M; 310/70 R, 70 A; 267/161, 163, 158

[56] References Cited

U.S. PATENT DOCUMENTS

| | | | |
|---|---|---|---|
| 3,173,306 | 3/1965 | Hoag | 267/163 X |
| 3,272,930 | 9/1966 | Frank | 200/19 M |
| 3,370,190 | 2/1968 | Neapolitakis | 123/148 E X |
| 3,390,668 | 7/1968 | Hufton | 315/209 T X |
| 3,889,650 | 6/1975 | Rivers | 123/146.5 A X |

FOREIGN PATENT DOCUMENTS

| | | | |
|---|---|---|---|
| 1,285,256 | 11/1960 | France | 267/163 |
| 84,529 | 3/1957 | Netherlands | 267/161 |

*Primary Examiner*—Charles J. Myhre
*Assistant Examiner*—Tony M. Argenbright

[57] ABSTRACT

An electronic ignition system for internal-combustion engines is disclosed, the system having a magnetic pulse unit using a sensor that produces a voltage trigger pulse in response to the rotation of a distributor shaft past a pole of a permanent magnet, the improvement comprising a flat-leaf spring having a plurality of relatively sharp corners mounted over a portion of the shaft so that the corners of the spring pass in close proximity to and disturb the magnetic field around the permanent magnet as the shaft rotates.

6 Claims, 1 Drawing Figure

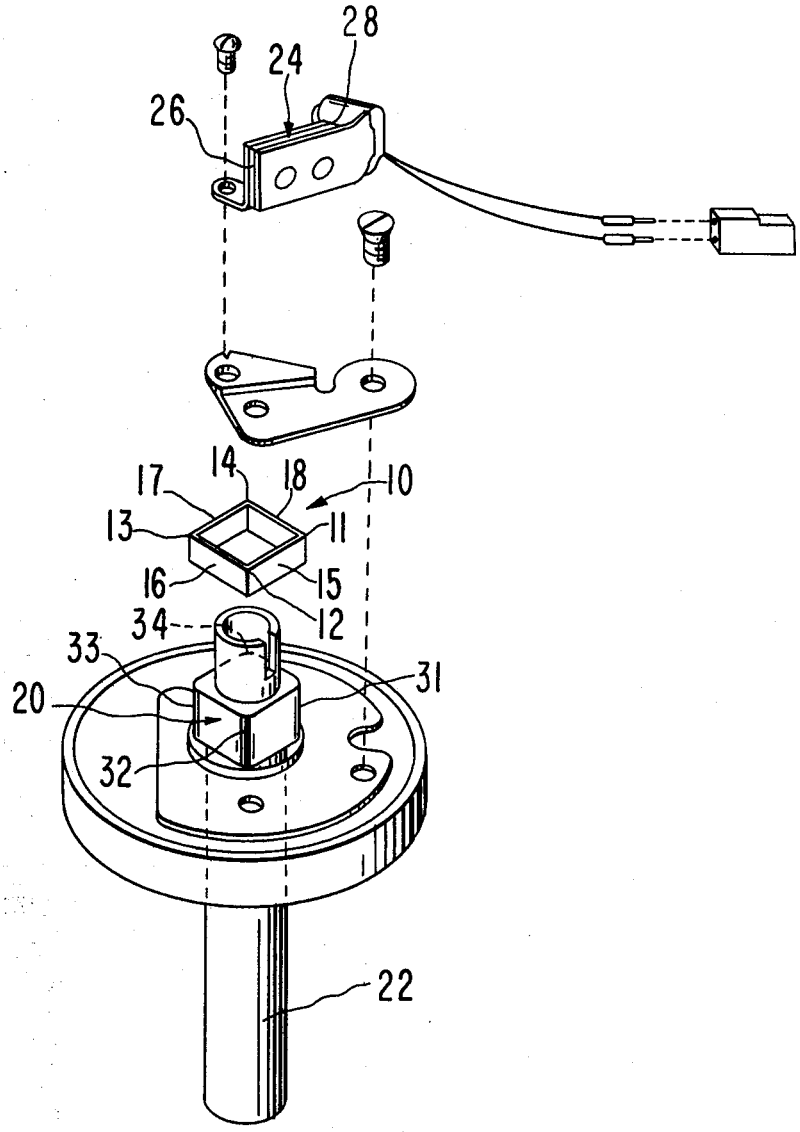
28
24
26
17
14
18
10
13
11
16
15
12
34
33
31
20
32
22

DISTRIBUTOR SPRING FOR USE IN A MAGNETIC SENSOR

BACKGROUND OF THE INVENTION

1. Field of the Invention

This invention is in the area of electronic-ignition systems for internal-combustion engines. In particular, this invention relates to an electronic-ignition system useful in converting the conventional point-contact ignition to electronic ignition.

2. Description of the Prior Art

In recent years, various kinds of electronic-ignition systems have been developed to replace the conventional contact-point ignition system, because the latter, while relatively simple and inexpensive, can be trouble prone. Electronic-ignition systems do away with the problems associated with the contact-point method either by eliminating the points themselves or by reducing the current flow through the points so they last longer. Most late-model American automobiles have some form of electronic-ignition systems, and owners of earlier models often desire to convert the ignition system of their automobile from the conventional point contact to electronic.

One type of electronic-ignition system useful in converting from point-contact ignition to electronic makes use of a magnetic-pulse unit for the trigger mechanism that turns the primary current in the ignition coil on and off. Automobiles have a rotatable shaft located in the distributor, at the end of which is a multisided cam, one side for each cylinder of the engine; conversion to an electronic-ignition system is made in part by mounting a plastic cap over the cam. Inbedded in the cap at equal distance from each other are a plurality of metal inserts of magnetic material, such as iron, with one insert for each cylinder of the engine. As the shaft rotates, the cam and plastic cap thereon and metal inserts therein revolve past a magnetic field, with the metal inserts momentarily disturbing the field at the correct time. Such a disturbance causes formation of a voltage trigger pulse that is amplified and used to control the primary current in the ignition coil.

The plastic-cap approach is useful because it can be mounted directly over the ditributor cam already existing in older model cars, does not require replacement, machining, nor modification of existing cam, any one of which could be prohibitively expensive. Because the plastic cap can be easily mounted over the existing distributor cam, the labor cost for such a conversion is relatively low.

Use of some device, such as the plastic-cap approach, is particularly needed to convert the ignition system of a four-cylinder engine where the distributor cam usually has four sides. As known in the art, the cam functions in conjunction with a rubbing block connected to the contact points to cause the contact points to separate at the correct time, as the shaft rotates. In order to reduce undesirable wear between the corners of the cam and the rubbing block, each of the corners, referred to as lobes, is rounded.

When conversion is made to an electronic-ignition system having a magnetic-pulse unit, the fact that the lobes of the cam are rounded means that even if the material of the cam were magnetic, the shape of the rounded lobes makes the existing cam undesirable by itself for use with the magnetic-pulse unit. Because the amplitude of the trigger pulse generated by a disturbance in the magnetic field is a function of the change in the magnetic field with time, it is essential that the disturbance occur over a very short period of time in order that the amplitude of the pulse be sufficiently high. When the corners of the cam are rounded, rather than at an angle of about 90° or less, the disturbance at slow engine speeds does not occur quickly enough to generate the desired trigger pulse.

By contrast, the metal inserts in a plastic cap as described above are relatively narrow and function when close to the magnetic field to instanteously disturb it, so that the voltage trigger pulse is of sufficient magnitude for normal engine speeds, such as from 500 to 2,500 revolutions per minute.

For maximum applitude of the trigger pulse, the metal inserts in the plastic cap should pass as close as possible to one pole of the magnet creating the magnetic field that the insert is designed to disturb. Preferably, the metal insert should be as close as 0.006 to 0.008 of an inch to the pole. There should be a minimum air gap between the stationary and rotating parts to allow for a margin of safety. However, in order for the plastic cap to hold in place the metal inserts as the shaft and cap rotate rapidly, especially at speeds above 2,500 revolutions per minute, the cap must be sufficiently thick to prevent the metal inserts from flying out of the cap. The thickness of the plastic cap needed to retain the metal inserts while allowing for a minimum air gap results in the metal inserts being further away from the pole than desirable; this, in turn, reduces the trigger voltage pulse, which is undesirable at slow engine speeds, such as around 100 revolutions per minute, which typically is the engine speed during starting.

Thus, there is a need for triggering mechanism to interrupt the magnetic field that is compatible with existing distributor cams, is inexpensive, can fit various sizes of distributor cams, allows the trigger mechanism to be close to a magnetic pole without reducing the air gap below a minimum level, and generates a sufficiently high voltage trigger pulse even during slow engine speeds.

BRIEF DESCRIPTION OF THE INVENTION

The device of the invention overcomes the above-mentioned problems of the prior art by providing a triggering mechanism that interrupts the magnetic field and causes a relatively high trigger voltage pulse to be generated, that is compatible with existing distributor cams, that is inexpensive, that can fit various sizes of distributor cams, that does not reduce the air gap below a minimum level, and that generates a sufficiently high trigger pulse even at slow engine speeds. Briefly, the device comprises a square-shaped flat-leaf spring of material having magnetic characteristics, such as low-carbon steel or iron.

BRIEF DESCRIPTION OF THE DRAWINGS

FIG. 1 is a simplified exploded isometric view of a portion of the ignition system showing the compensator spring of the invention for mounting over the distributor cam.

DESCRIPTION OF THE PREFERRED EMBODIMENT

Referring to FIG. 1, the compensator spring of the invention for four-cylinder internal-combustion engines comprises a flat-leaf spring 10. Spring 10 comprises a magnetic material, such as a relatively low-carbon steel, or iron. Each of the four corners 11 through 14 is relatively sharp compared to the rounded corners of cams in four-cylinder engines using the conventional point-contact ignition system. Spring 10 is mounted over the cam portion 20 of the shaft 22 and turns as the shaft 22 rotates. Spring 10 is located on cam 20 in close proximity to one pole of a permanent magnet 24, for example, the N pole 26 of magnet 24. The S pole 28 is at the opposite end of magnet 24. As the shaft 22 rotates, the sides 15 through 18 of spring 10 are too far away to cause disturbance of the magnetic field around magnet 24. However, corners 11 through 14 of spring 10 pass in close proximity to N pole 26, and disturb the magnetic field.

Suitably, the minimum air gap between each of corners 11 through 14 of spring 10 and N pole 26 of magnet 24 is from about 0.006 to 0.008 of an inch. By contrast, the air gap between N pole 26 of magnet 24 and each of the sides 15 through 18 in spring 10 is about 0.125 of an inch. Each of the corners 11 through 14 of the square-shaped spring 10 is relatively sharp compared to the rounded corners 31 through 34 of cam 20, so that interruption of the magnetic field occurs in a very short period of time, even at slow engine speeds. As known in the art, the magnitude of the trigger pulse is a function of the change in magnetic flux with time; accordingly, the sharp corners 11 through 14 substantially increase the magnitude of the trigger pulse. The magnitude of the trigger pulse generated by the spring 10 is higher than that generated by the above-mentioned cap with metal inserts, because corners 11 through 14 of spring 10 pass closer to the N pole 26 of magnet 20, and a greater portion of the magnetic field is disturbed.

The close proximity of the narrow corners 11 through 14 of spring 10 to pole 26 ensure that even at slow engine speeds, such as around 100 revolutions per minute, a sufficient trigger pulse is generated that can be detected, amplified and converted by an ignition coil to a very high voltage, such as about 26,000 volts, for firing a spark plug and igniting fuel in a cylinder.

Suitably, the spring 10 can be of different sizes in accordance with the different sizes of the distributor cam 20. The characteristics of spring 10 allow it to be expanded easily and slipped over the end of a distributor cam 20, where the spring 10 is held firmly in place by its radial spring force, even during high rotation of cam 20.

A typical length of a side of the spring 10 is from about 0.5 to 0.7 of an inch.

I claim:

1. An electronic-ignition system for internal-combustion engines, the system having a magnetic-pulse unit using a sensor that produces a voltage trigger pulse in response to the rotation of a distributor shaft past a pole of permanent magnet, the improvement comprising a flat-leaf spring having a plurality of relatively sharp corners mounted over a portion of the shaft so that the corners of the spring pass in close proximity to and disturb the magnetic field around the permanent magnet as the shaft rotates.

2. The system of claim 1 wherein the flat-leaf spring is square.

3. The system of claim 1 wherein the flat-leaf spring comprises a material with magnetic properties.

4. The system of claim 1 wherein the flat-leaf spring comprises a relatively low carbon steel.

5. The system of claim 1 wherein the flat-leaf spring comprises iron.

6. A method of converting point contact ignition for an internal combustion engine to an electronic ignition system having a magnetic-pulse unit that produces a voltage trigger pulse in response to the rotation of the engine distributor cam past a pole of permanent magnet, comprising the steps of mounting said magnet pole in predetermined closely spaced relation to said distributor cam, and mounting a flat-leaf spring having a plurality of relatively sharp corners over said distributor cam so that the corners of the spring pass in close proximity to and disturb the magnetic field around said magnet pole as the cam rotates.

* * * * *